US006318881B1

(12) United States Patent
Lawrence

(10) Patent No.: US 6,318,881 B1
(45) Date of Patent: Nov. 20, 2001

(54) OPENABLE LIGHT BULB SOCKET ASSEMBLY

(76) Inventor: Geremy D. Lawrence, 7020 Limekiln Pike, Philadelphia, PA (US) 19138

( * ) Notice: Subject to any disclaimer, the term of this patent is extended or adjusted under 35 U.S.C. 154(b) by 0 days.

(21) Appl. No.: 09/649,804

(22) Filed: Aug. 29, 2000

(51) Int. Cl.[7] ..... H01R 33/00
(52) U.S. Cl. ..... 362/226; 439/257
(58) Field of Search ..... 362/226, 443, 362/437, 438; 313/318.01, 318.04, 317; 439/257, 254, 256, 371, 366, 611, 615

(56) References Cited

U.S. PATENT DOCUMENTS 4,183,604 * 1/1980 Tjornhom ..... 439/300
5,329,832 * 7/1994 Tegethoff ..... 81/3.55
5,511,989 * 4/1996 Cheng ..... 439/419
5,622,513 * 4/1997 Kuang ..... 439/340
5,688,138 * 11/1997 Chaung ..... 439/280

* cited by examiner

*Primary Examiner*—Alan Cariaso
*Assistant Examiner*—Hargobind S. Sawhney
(74) *Attorney, Agent, or Firm*—Caesar, Rivise, Bernstein, Cohen & Pokotilow, Ltd.

(57) ABSTRACT

An openable light bulb socket assembly arranged for enabling the removal of the base of a broken light bulb. The inventive socket assembly includes a socket member arranged for receiving the light bulb therein. The socket member is moveable between a retaining position for retaining the light bulb base therein and a releasing position to enable removal of the light bulb base therefrom. The assembly also includes a collar arranged for surrounding the socket member and holding the socket member in the retaining position. The collar is easily removable from the socket member to permit movement of the socket member from the retaining position to the releasing position to enable removal of the light bulb base therefrom. The assembly also includes a base portion arranged for engagement in mating relation with a conventional lamp socket.

17 Claims, 4 Drawing Sheets

OPENABLE LIGHT BULB SOCKET ASSEMBLY

BACKGROUND OF THE INVENTION

This invention relates generally to the field of light bulb sockets and in particular to a light bulb socket assembly that is openable to enable the removal of a broken light bulb therefrom.

Typically, incandescent light bulbs include a metallic base, usually threaded, and a contact insulated from the base. A pair of lead wires project from the base and the contact, respectively, into a glass bulb adhesively affixed to the base. A filament extends between the lead wires. When an electric current is applied through the filament it glows to produce light.

Quite often, incandescent light bulbs break while disposed within an electrical lamp socket. This breakage results for several reasons, e.g., use of an improper bulb type or wattage. Such improper usage usually results in the bursting of the fragile glass bulb. Screw-type incandescent bulbs are fastened to and removed from the socket by rotating the glass bulb portion. If the base is properly screwed into its socket, it is extremely difficult to grip the base sufficiently to dislodge it from the socket if the glass bulb has shattered. Therefore, there is a need to enable the safe removal of the base of the broken light bulb from the electrical lamp socket.

One solution is to cut off power to the light and attempt to grip the light bulb base with a tool such as a pliers in an effort to rotate the base out of the socket. This poses an electrocution risk if the power has not been properly disconnected from the light. Additionally, small shards of glass projecting from the base can easily cut the hand of a person attempting to remove the broken light bulb in this manner. Also, these glass shards can fall onto the person attempting to remove the broken bulb. Moreover, because the base of the bulb is thin metal that is easily deformable, the base may become jammed in the socket. Another solution is to physically clear away the remnants of the broken glass and attempt to rotate the base with one's fingers.

Tools for removing the bases of broken light bulbs from an electrical socket are known in the prior art. Many have been developed as the result of the difficulty encountered when attempting remove the base of a shattered light bulb as described above. Examples of such tools are disclosed in U.S. Pat. No. 5,937,714 (Sherman et al.); U.S. Pat. No. 5,829,324 (Secor) U.S. Pat. No. 5,490,438 (Zupo et al.); U.S. Pat. No. 5,458,029 (Walsky); and, U.S. Pat. No. 4,485, 701 (Hough). While the devices disclosed in the aforementioned patents may be suitable for their intended purposes, it would be a clear advantage of over the prior art to eliminate the necessity for any of these extraction tools by providing an electrical socket that was readily openable from a closed position to enable easy removal of a broken light bulb base.

OBJECTS OF THE INVETION

Accordingly, it is a general object of this invention to provide an openable light bulb socket assembly that overcomes the disadvantages of prior art.

It is a more specific object of this invention to provide an openable light bulb socket assembly that has a high durability and long life span.

It is also a specific object of this invention to provide an openable light bulb socket assembly that is less expensive to manufacture than prior art methods and devices.

It is also a specific object of this invention to provide an openable light bulb socket assembly that may be quickly and easily attached to and removed from a conventional lamp socket.

It is also a specific object of this invention to provide an openable light bulb socket assembly which is simple in construction.

It is also a specific object of this invention to provide an openable light bulb socket assembly which is reliable in operation and easy to use.

It is also a specific object of this invention to provide an openable light bulb socket assembly which has many of the advantages over tools for extracting broken bulbs.

It is also a specific object of this invention to provide an openable light bulb socket assembly that enables removal of the base of a broken light bulb without the use of a separate extraction tool.

It is also a specific object of this invention to provide an openable light bulb socket assembly which avoids the risk of electric shock to the user.

SUMMARY OF THE INVENTION

These and other objects of this invention are achieved by providing an openable light bulb socket assembly arranged for enabling the removal of the base of a broken light bulb. The inventive socket assembly includes a socket member arranged for receiving the light bulb therein. The socket member is moveable between a retaining position for retaining the light bulb base therein and a releasing position to enable removal of the light bulb base therefrom. The assembly also includes a collar arranged for surrounding the socket member and holding the socket member in the retaining position. The collar is easily removable from the socket member to permit movement of the socket member from the retaining position to the releasing position to enable removal of the light bulb base therefrom. The assembly also includes a base portion arranged for engagement in mating relation with a conventional lamp socket.

In a variation of the disclosed embodiment, the socket member comprises a first arcuate section and a second arcuate section.

In another variation of the disclosed embodiment, the first and second arcuate sections are arranged for mating along a central vertical plane of the socket member.

In another variation of the disclosed embodiment, the first and second arcuate sections are symmetrical.

In another variation of the disclosed embodiment, the first and second arcuate sections are provided with internal threads for engagement in mating relation with external threads provided on the light bulb base.

In another variation of the disclosed embodiment, the socket member comprises an internal circumference approximately equal to the internal circumference of the conventional lamp socket to enable insertion and engagement of the light bulb base with the socket member.

In another variation of the disclosed embodiment the socket member is provided with internal threads for engagement with external threads provide on the light bulb base.

In another variation of the disclosed embodiment, the base portion is provided with external threads for engagement with internal threads provided on the conventional lamp socket.

In another variation of the disclosed embodiment, the base portion is arranged for engagement in mating relation with a ceiling mounted lamp socket.

In another variation of the disclosed embodiment, the collar comprises a removable strap arranged to be fitted over and surround the socket member to retain the socket member in the retaining position.

In another variation of the disclosed embodiment, the removable strap is formed of a flexible material and is of a sufficient length to enable the strap to extend over itself in an overlapping fashion.

In another variation of the disclosed embodiment, the strap is provided with hook and loop fasteners at its ends.

In another variation of the disclosed embodiment, the strap is adhered to the socket member by gluing.

In another variation of the disclosed embodiment, the collar comprises an internally threaded coupling arranged for threaded engagement with an externally threaded socket member.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
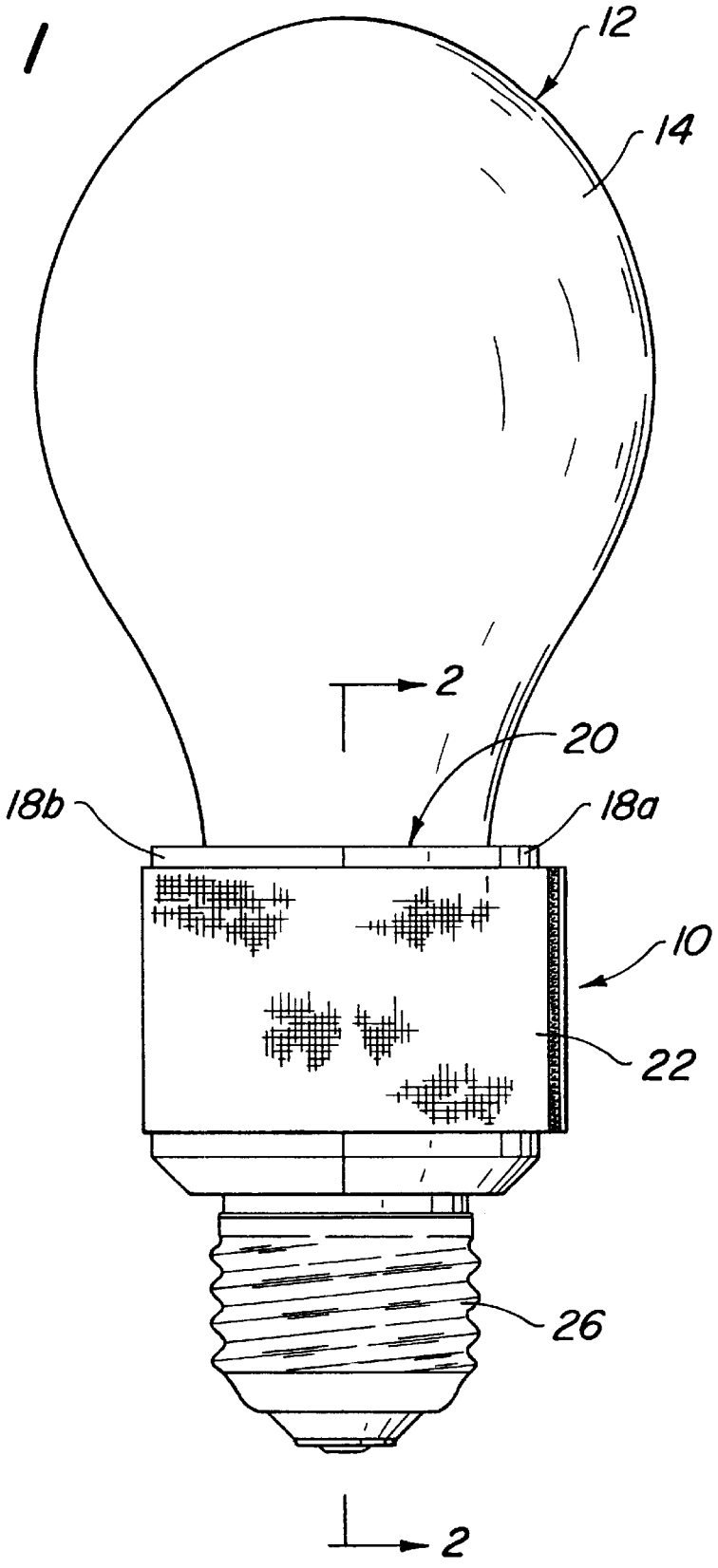
FIG. 1 is a side elevational view of the openable light bulb socket assembly of the present invention with an incandescent light bulb installed therein.
Figure 2:
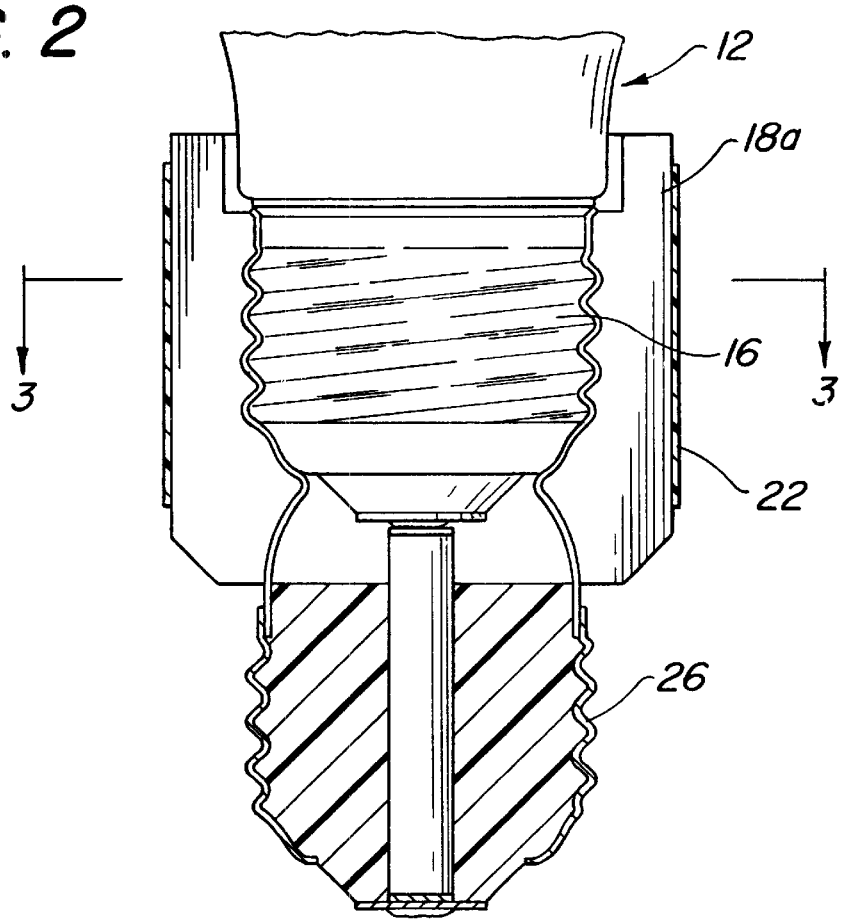
FIG. 2 is a sectional view taken through line 2—2 of FIG. 1.
Figure 3:
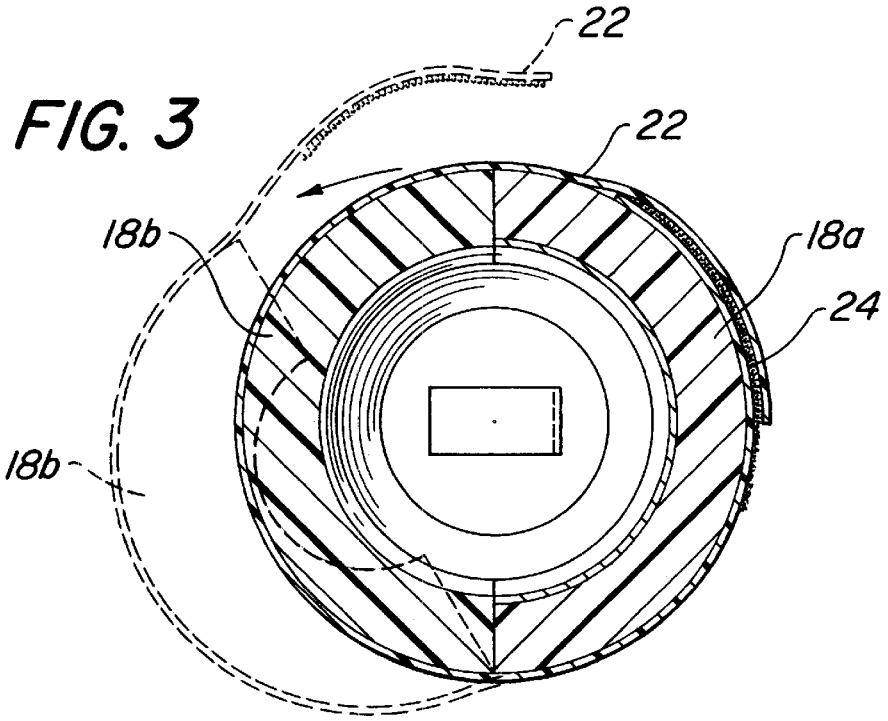
FIG. 3 is a sectional view taken through line 3—3 of FIG. 2.

Referring now to the various figures of the drawing wherein like reference characters refer to like parts, there is shown at 10 in FIG. 1 an embodiment of the openable light bulb socket assembly arranged for enabling the extraction of the threaded base of a shattered light bulb. As shown in FIG. 1, the socket assembly 10 is shown with an inandescent bulb 12 mounted therein. The incandescent bulb 12 includes a glass bulb portion 14 and a base 16 (best seen in FIG. 2) having an external thread formed thereon. Referring now to FIGS. 1–3, the socket assembly 10 is relatively small in size and includes a split body structure that is formed of two equal arcuate sections 18*a* and 18*b* that may be hingedly connected. The arcurate sections of the body structure are preferably molded of a plastic insulation material such as polycarbonate. Each of the two arcuate sections 18*a* and 18*b* is internally threaded such that when the two arcuate sections are mated, they form a female socket 20 having a continuous internal thread that is enageable with the external thread formed on the base 16 of the bulb 12.

A removable collar 22 is arranged to be fitted over and surround the arcuate sections 18*a* and 18*b* of the female socket 20 to retain the arcuate sections 18*a* and 18*b* together in a retaining position to enable installation and retention of the threaded base 16 of the bulb 12 therein. As best shown in FIG. 3, the removable collar 22 is formed of any suitable flexible material having a length and two ends. The removable collar 22 is of sufficient length to enable it to be wrapped around the arcuate sections 18*a* and 18*b* and thereafter to extend over itself in an overlapping fashion. At its ends, the removable collar 22 is provided with hook and loop fasteners 24, e.g, VELCRO®, to enable the removable collar 22 to be affixed to itself after being wrapped around the arcuate sections 18*a* and 18*b* to retain the arcuate sections together in their retaining position as shown in FIG. 3. In this manner, the base 16 of the incandescent bulb 12 may be screwed into the female socket 20 of the socket assembly 10. The removable collar 22 may be adhered to the arcuate sections 18*a* and 18*b* by any suitable means, e.g., gluing. Because the removable collar 22 is adhered to the arcuate sections, 18*a* and 18*b*, as best shown in FIG. 3, when moving the arcuate sections 18*a* and 18*b* from their retaining position socket (shown in solid line) to their receiving position (arcuate section 18*b* shown in phantom), the removble collar 22 serves as a living hinge to allow the pivotable separation and adjoining of the arcuate sections 18*a* and 18*b*. Alternatively, the arcuate sections 18*a* and 18*b* may be joined together at one end by a hinge (not shown) to enble pivotable movement of the arcuate sections 18*a* and 18*b* from the retaining position to the releasing position.

Figure 5:
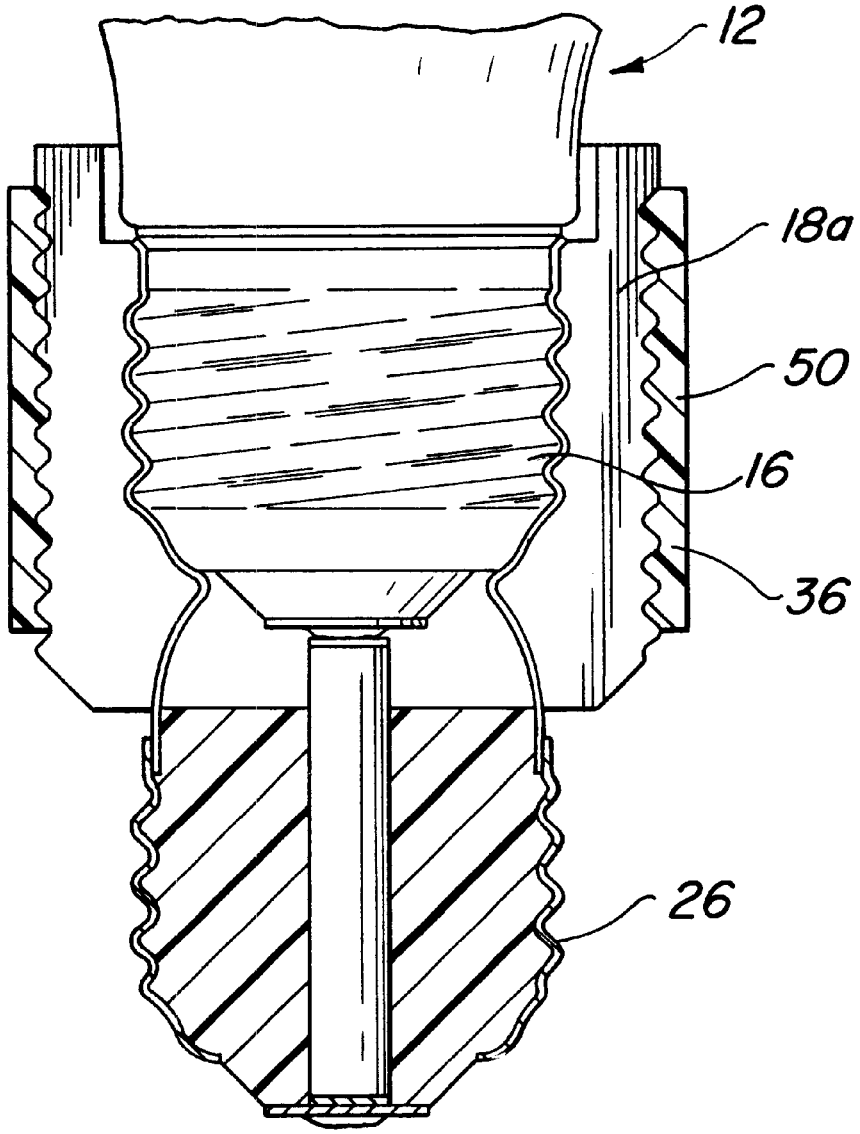

At this juncture, it is important to mention that the removable collar 22 is merely one example of many different ways in which the arcuate sections 18*a* and 18*b* may be held together for retaining the base 16 of the incandescent bulb 12. For example, an alternative embodiment of the openable light bulb socket assembly 10 of the present invention is shown in FIG. 5. Under this embodiment, each of the two arcuate sections 18*a* and 18*b* is externally threaded such that when the two arcuate sections are mated in the retaining position, they form a continuous external thread that is engageable with an internally threaded collar 50 arranged to be screwed onto the arcuate sections 18*a* and 18*b* of the female socket 20 to retain the arcuate sections 18*a* and 18*b* together in their retaining position to enable installation and retention of the base 16 of the bulb 12 therein.

Referring again to FIG. 1, the socket assembly 10 also includes an externally threaded base portion 26 that is sized to be engageable with a standard light bulb socket. That is, the base portion 26 is substantially the same size as the base 16 of the incandescent bulb 12 and therefore, is adapted to be screwed into a conventional on-off type lamp fixture socket (not shown) to make electrical contact with the terminals therein.

Referring now to FIG. 3, in the event the glass bulb portion 14 of an incandescent light bulb 12 shatters while disposed within the openable light bulb socket asssembly 10 of the preset invention, once power has been terminated, the removable collar 22 may easily be unwrapped, as shown in phantom in FIG. 3, to enable movement of the arcuate section 18*b* away from the arcuate section 18*a*. In this manner, the arcuate sections 18*a* and 18*b* move from their previously explained retaining position to their releasing position thus enabling easy extraction of the base 16 of the incandescent light bulb 12 from the openable light bulb socket assembly 10. After extraction of the base 16 of the incandescent light bulb 12, the arcuate sections 18*a* and 18*b* may be returned to the retaining position and the removable collar 22 fitted thereover to surround the arcuate sections 18*a* and 18*b* and hold them together in the retaining position to enable installation and retention of a new bulb 12 therein. Under the alternative embodiment shown in FIG. 5, in the event the glass bulb 14 portion shattters, the collar 50 may be eaily unscrewed from the externally threaded halves 18*a* and 18*b* to enable movement of the arcuate sections 18*a* and 18*b* from their retaining position to their releasing position thus enabling easy extraction of the base 16 of the bulb 12 from the socket assembly 10.

Figure 4:
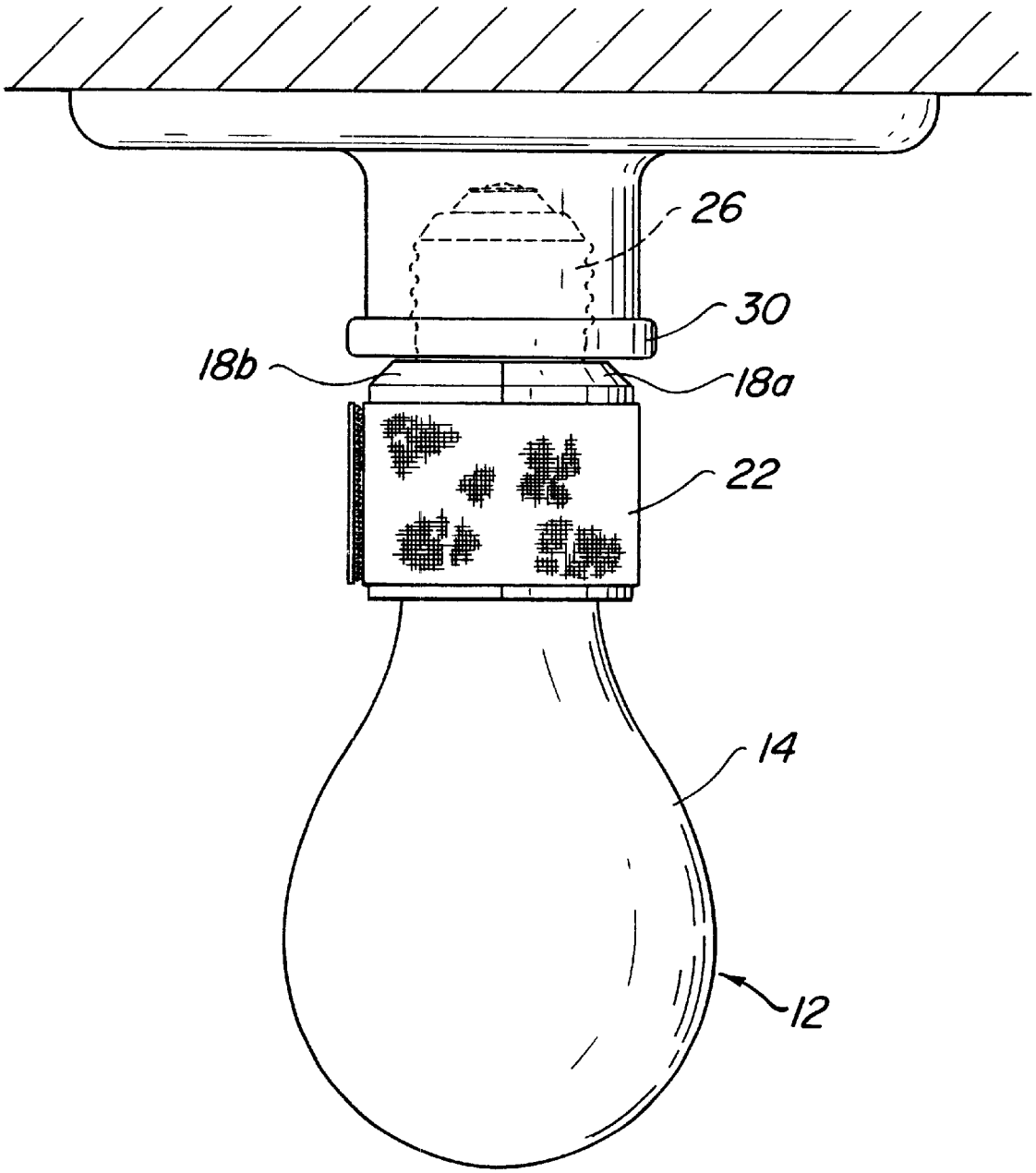
FIG. 4 is a side elevational view of the openable light bulb socket assembly of the present invention with an incandescent light bulb installed therein, the assembly being mounted within a ceiling mounted light bulb socket assembly; and, FIG. 5 is a side elevational view of an alternative embodiment of the openable light bulb socket assembly of the present invention formed of two arcuate sections being held together with a coupling rather than a fabric strip.

FIG. 4 illustrates the versatility of the openable light bulb socket assembly 10 of the present invention in that it adapted to be screwed into a ceiling mounted lamp socket 30 rather for mounting into the conventional on-off type lamp fixture socket as discussed above.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to without departing from the scope of the invention.

I claim:

1. An openable socket assembly aged to enable the quick removal of a threaded portion of a broken light bulb therefrom, said openable socket assembly comprising:

a. a socket member arranged for receiving the threaded portion of the light bulb therein, said socket member being moveable between a retaining position for retaining the light bulb threaded portion therein and a releasing position to enable removal of the light bulb threaded portion therefrom;

b. a collar arranged for surrounding said socket member and holding said socket member in said retaining position, said collar being easily removable from said socket member to permit movement of said socket member from said retaining position to said releasing position to enable removal of the light bulb threaded portion therefrom; and, c. a base portion integral with said socket member and arranged for engagement in mating relation with a conventional lamp socket.

2. The openable socket assembly of claim 1 wherein said socket member comprises a first arcuate section and a second arcuate section.

3. The openable socket assembly of claim 2 wherein said first and second arcuate sections are arranged for mating along a central vertical plane of the socket member.

4. The openable socket assembly of claim 3 wherein said first and second arcuate sections are symmetrical.

5. The openable socket assembly of claim 4 wherein said first and second arcuate sections are provided with internal threads for engagement in mating relation with the threaded portion of the light bulb.

6. The openable socket assembly of claim 5 wherein said socket member comprises an internal circumference approximately equal to the internal circumference of a conventional lamp socket to enable insertion and engagement of the light bulb threaded portion said socket member.

7. The openable socket assembly of claim 6 wherein the socket member is provided with internal threads is for engagement with the threaded portion of the light bulb.

8. The openable socket assembly of claim 2 wherein said first and second arcuate sections are pivotally interconnected at one end for pivotal movement of the arcuate sections between said retaining position and said releasing position.

9. The openable socket assembly of claim 1 wherein said base portion is provided with external threads for engagement with internal threads provided on the conventional lamp socket.

10. The openable socket assembly of claim 1 wherein said base portion is arranged for engagement in mating relation with a ceiling mounted lamp socket.

11. The openable socket assembly of claim 1 wherein said collar comprises a removable strap arranged to be fitted over and surround said socket member to retain said socket member in said retaining position.

12. The openable socket assembly of claim 11 wherein said removable strap is formed of a flexible material.

13. The openable socket assembly of claim 12 wherein said strap includes a length and two ends and is of sufficient length to enable it to be wrapped around the socket member and thereafter to extend over itself in an overlapping fashion.

14. The openable socket assembly of claim 13 wherein said strap is provided with hook and loop fasteners at its ends.

15. The openable socket assembly of claim 14 wherein said strap is adhered to said socket member.

16. The openable socket assembly of claim 15 wherein said strap is adhered to said socket member by gluing.

17. The openable socket assembly of claim 11 wherein said collar is arranged for threaded engagement with said socket member.

* * * * *